US007464793B2

(12) United States Patent
Komatsu

(10) Patent No.: US 7,464,793 B2
(45) Date of Patent: Dec. 16, 2008

(54) OPERATING UNIT OF ELEVATOR AT THE TIME OF POWER INTERRUPTION

(75) Inventor: Masashi Komatsu, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 489 days.

(21) Appl. No.: 10/568,412

(22) PCT Filed: Jun. 24, 2004

(86) PCT No.: PCT/JP2004/008892

§ 371 (c)(1),
(2), (4) Date: Feb. 14, 2006

(87) PCT Pub. No.: WO2006/001053

PCT Pub. Date: Jan. 5, 2006

(65) Prior Publication Data

US 2006/0231348 A1 Oct. 19, 2006

(51) Int. Cl.
*B66B 1/06* (2006.01)

(52) U.S. Cl. ..... 187/290; 187/313; 187/384

(58) Field of Classification Search ..... 187/247, 187/277, 289, 290, 293–299, 306, 313, 380, 187/384, 388, 390, 391, 393; 307/66, 69
See application file for complete search history.

(56) References Cited

U.S. PATENT DOCUMENTS 5,780,788 A * 7/1998 Eschenbrenner et al. .... 187/316
5,894,910 A * 4/1999 Suur-Askola et al. ..... 187/290
6,000,505 A * 12/1999 Allen ..... 187/391
7,040,458 B2 * 5/2006 Forsythe et al. ..... 187/396
7,182,174 B2 * 2/2007 Parrini et al. ..... 182/18
7,210,564 B2 * 5/2007 Kawai ..... 187/384
2007/0163845 A1 * 7/2007 Kawai ..... 187/313
2007/0278044 A1 * 12/2007 Hikita et al. ..... 187/247
2008/0067006 A1 * 3/2008 Hikita et al. ..... 187/247

FOREIGN PATENT DOCUMENTS

| | | |
|---|---|---|
| JP | 2-106581 | 4/1990 |
| JP | 6-227769 | 8/1994 |
| JP | 11-209019 | 8/1999 |
| JP | 2002-29670 | 1/2002 |
| JP | 3331855 | 7/2002 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

An emergency power operation apparatus of an elevator that operate machines in a firefighter operation according to the situation in a case where a power failure occurs during firefighter operations during a fire and a switchover to an emergency power source occurs. A group-management controller causes machines not in firefighter operation to preferentially return to an evacuation floor or a rescue floor when a power failure occurs during firefighter operations during a fire and then makes machines in firefighter operation operational. In a case where there are multiple machines in firefighter operation after all machines not in firefighter operation have finished returning to an evacuation floor or a rescue floor, if there is a machine at a standstill outside a door zone among the machines in firefighter operation, the group-management controller causes that machine at a standstill outside the door zone to preferentially become operational.

7 Claims, 4 Drawing Sheets

OPERATING UNIT OF ELEVATOR AT THE TIME OF POWER INTERRUPTION

TECHNICAL FIELD

The present invention relates to an emergency power operation apparatus of an elevator which is used for an elevator which is operated by an emergency power source during a power failure and supports emergency recall operations during emergencies such as a fire and fire fighting activities by firefighter operations.

BACKGROUND ART

There have been proposed emergency power operation methods of an elevator which are used for an emergency elevator which can perform emergency recall operations and firefighter operations during a fire and which has no dedicated emergency power source as a matter of convenience of building facilities and hence has no other choice than to perform emergency recall operations and firefighter operations during a power failure by use of a common emergency power source shared by other machines (refer to the Patent Document 1, for example).

Patent Document 1: Japanese Patent No. 3331855

DISCLOSURE OF THE INVENTION

However, the prior art does not mention a case where a power failure occurs when there are other machines which have already been performing firefighter operations, and has problems as described below.

The first problem lies in the point that no consideration is given to an operation method in a case where a car which does not perform firefighter operations during an emergency is at a standstill outside a door zone. The second problem lies in the point that no consideration is given to an operation method in a case Where multiple elevators have been performing firefighter operations.

The present invention has been made to solve problems as described above and has as its object the provision of a emergency power operation apparatus of an elevator which can appropriately operate an elevator in firefighter operation according to the situation in a case where a power failure occurs during the firefighter operations during a fire and a switchover to an emergency power source occurs.

The present invention provides an emergency power operation apparatus of an elevator in which multiple cars are operated one by one during a power failure by use of an emergency power source, characterized in that the emergency power operation apparatus of an elevator comprises group-management controlling means which causes machines not in firefighter operation to preferentially return to an evacuation floor or a rescue floor when a power failure occurs during firefighter operations during a fire and then makes machines in firefighter operation operational.

Also, in that in a case where there are multiple machines in firefighter operation after all machines not in firefighter operation have finished returning to an evacuation floor or a rescue floor, if there is a machine at a standstill outside a door zone among the machines in firefighter operation, the group-management controlling means causes this machine at a standstill outside the door zone to preferentially become operational.

Further, in that the group-management controlling means comprises external information inputting means which inputs external information necessary for travel control of elevators in a group, returning machine deciding means which outputs a return order in consideration of the number of elevators capable of being simultaneously operated among the multiple elevators, a predetermined order of priority and the number of machines in firefighter operation in the group, and continuation machine deciding means which outputs a continuation order in consideration of the number of elevators capable of being simultaneously operated, a predetermined order of priority, and the number of machines in firefighter operation in the group.

Furthermore, in that within a car of each machine there is provided means which displays machines in firefighter operation in the group, machines operational by firefighter operation, and positions of cars of other machines.

In the present invention, general passengers can be swiftly rescued even in a case where a power failure occurs when the capacity of an emergency power source is only for one elevator and firefighter operations during an emergency are being performed, and even in a case where multiple elevators are performing firefighter operations, a continuation order is preferentially outputted to an elevator in firefighter operation which has come into a standstill outside a door zone, with the result that rescue is possible even when a power failure occurs during the fire fighting activities by firefighters. Although one machine becomes unoperational while multiple machines are in firefighter operation, this unoperational machine can be rescued because the positions of the other machines can be recognized from within a car.

DESCRIPTION OF SYMBOLS

Figure 1:
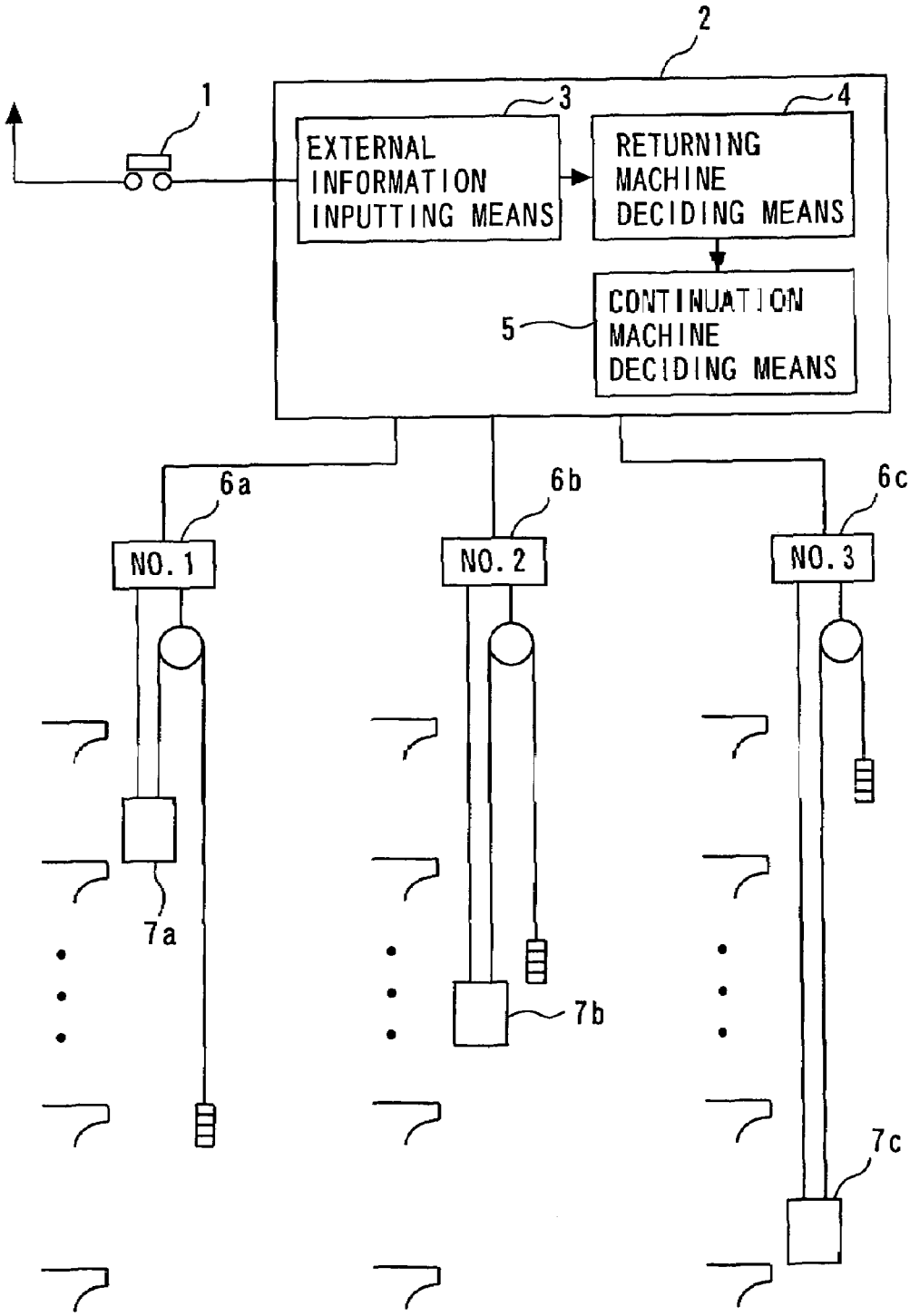
FIG. 1 is a system configuration diagram which shows a emergency power operation apparatus of an elevator in Embodiment 1 of the present invention.

1 Identification contact of emergency power source
2 Group-management controlling means
3 External information inputting means
4 Returning machine deciding means
5 Continuation machine deciding means
6*a*, 6*b*, 6*c* Individual-machine controlling means
7*a*, 7*b*, 7*c* Elevator car
8 Car display controlling means
9 In-car operating panel
10 Emergency (firefighter) operation lamp
11 Emergency car position indicator-cum-firefighter operation lamp for No. 2 machine
12 Emergency car position indicator for No. 3 machine

BEST MODE FOR CARRYING OUT THE INVENTION

The present invention will be described in detail with reference to the accompanying drawings.

Embodiment 1

FIGS. 1 to 4 show an emergency power operation apparatus of an elevator in Embodiment 1 of the present invention. This is an example in which three elevator cars are group-managed as one group. Among the three elevators, the No. 1 machine is for emergency use, the No. 2 machine is for emergency use, and the No. 3 machine is for general purpose. The capacity of an emergency power source is for one elevator.

FIG. 1 is a system configuration diagram which shows a emergency power operation apparatus of an elevator in Embodiment 1 of the present invention.

In the figures, an identification contact of emergency power source 1 is a normally opened contact which is closed when a switchover to an emergency power source occurs. Group-management controlling means 2 performs the travel control of the elevators in the group. In the present invention, operational elevators during a power failure are controlled by use of external information inputting means 3, returning machine deciding means 4 and continuation machine deciding means 5. The above-described external information inputting means 3 inputs external information necessary for the travel control of the elevators in the group. In the present invention, the identification contact of emergency power source 1 is inputted from the building side. The above-described returning machine deciding means 4 outputs a return order in consideration of the number of elevators capable of being simultaneously operated, a predetermined order of priority and the number of machines in firefighter operation in the group when multiple elevators are installed. The above-described continuation machine deciding means 5 outputs a continuation order in consideration of the number of elevators capable of being simultaneously operated, a predetermined order of priority and the number of machines in firefighter operation in the group. Individual-machine controlling means 6*a*, 6*b*, 6*c* of elevators performs the travel control of each elevator (each machine). In the present invention, when a return order during a power failure is received from the group-management controlling means 2, the elevator travels to a predetermined return floor or evacuation floor. When a continuation order during a power failure is received from the group-management controlling means 2, the operation is continued even during a power failure. The reference numeral 6*a* denotes No. 1 elevator controlling means, the reference numeral 6*b* denotes No. 2 elevator controlling means, and the reference numeral 6*c* denotes No. 3 elevator controlling means. An elevator car 7*a* is a car for the No. 1 machine, an elevator car 7*b* is a car for the No. 2 machine, and an elevator car 7*c* is a car for the No. 3 machine.

Figure 2:
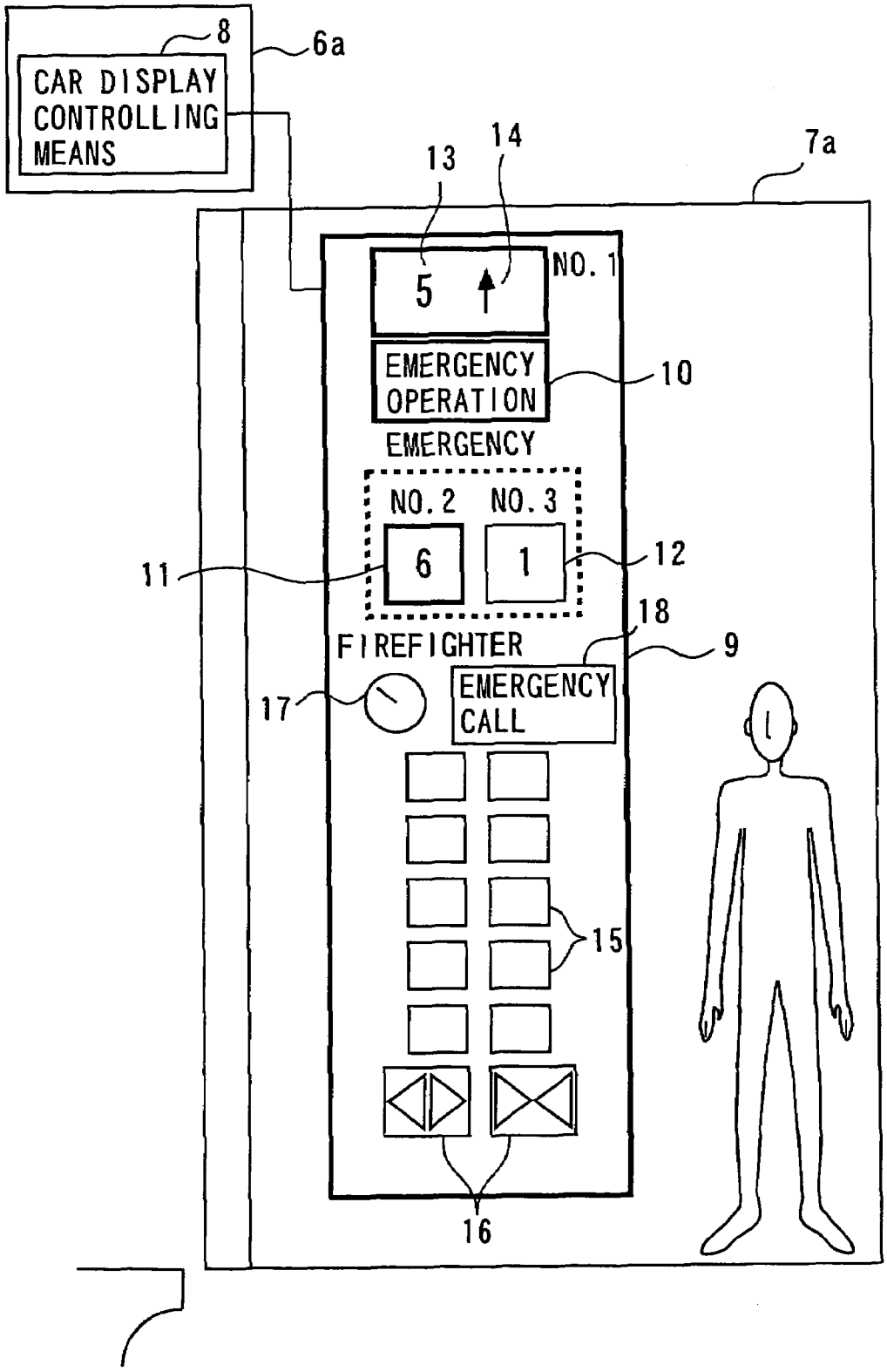
FIG. 2 is in-car display means of an emergency power operation apparatus of an elevator in Embodiment 1 of the present invention.

FIG. 2 is in-car display means of an emergency power operation apparatus of an elevator in Embodiment 1 of the present invention. This diagram shows a schematic representation of the No. 1 machine 7*a*.

Car display controlling means 8 outputs control signals related to car display, such as those of a car position indicator, an in-car direction lamp, a destination button lamp and a door opening and closing button lamp, from the individual-machine controlling means 6*a*, 6*b*, 6*c*. In the present invention, an emergency operation lamp 10 which indicates whether the relevant machine is in emergency operation (emergency recall operation or firefighter operation), a car position indicator-cum-firefighter operation lamp 11 for the No. 2 machine, which is a display of another machine during emergency operation, and a car position indicator 12 for the No. 3 machine are also controlled. On an in-car operating panel 9, there are installed a car position indicator 13 of the relevant machine, an in-car direction lamp 14, destination lamps 15 and destination button lamps, door opening and closing buttons 16 and door opening and closing button lamps, furthermore, an emergency operation lamp 10, the car position indicator-cum-firefighter operation lamp 11 for the No. 2 machine, the car position indicator 12 for the No. 3 machine, a firefighter operation switch 17, and an emergency call button 18. The emergency operation lamp 10 lights up when the relevant machine is in emergency operation (emergency recall operation, firefighter operation). In the present invention, the emergency operation lamp 10 blinks when there is no continuation order from the group-management controlling means 2 while firefighting operations are being performed by use of an emergency power source. The car position indicator-cum-firefighter operation lamp 11 for the No. 2 machine becomes able to perform indication during firefighting operations and displays the car position of the No. 2 machine which is inputted from the group-management controlling means 2. A quadrangular peripheral part of this car position indicator serves also as the firefighter operation lamp of the No. 2 machine and hence the firefighter operation lamp 11, which is the quadrangular peripheral part of this car position indicator, lights up and the emergency operation lamp 10 of the No. 1 machine blinks when a continuation order is issued from the group-management controlling means 2 to the No. 2 machine and this No. 2 machine is operational in the firefighter operation mode. Conversely, when a continuation order is issued from the group-management controlling means 2 to the No. 1 machine and this No. 1 machine is operational in the firefighter operation mode, the emergency operation lamp 10 of the No. 1 machine lights up and the firefighter operation lamp 11 of the No. 2 machine blinks. Also, if the No. 2 machine is not in firefighter operation, this firefighter operation lamp 11 goes off. In this manner, the execution condition of firefighter operations of other machines in the group can be displayed. As a result of this, it is possible to confirm the information that a machine is unoperational because no continuation order is issued from the group-management controlling means 2 and, therefore, it is possible to move to the floor of the machine and to rescue firefighters who are riding in the unoperational machine. The car position indicator 12 of the No. 3 machine becomes able to perform indication during firefighting operations and displays the car position of the No. 3 machine which is inputted from the group-management controlling means 2. When a power failure occurs while the No. 1 and No. 2 machines are in firefighter operation, the No. 3 machine not in firefighter operation returns first. However, firefighters who are waiting in the cars of the No. 1 and No. 2 machines can ascertain from the car position indicator 12 whether the No. 3 machine has arrived at a return floor or an evacuation floor and, therefore, the waiting firefighters can judge whether the relevant machine is operational. Incidentally, because the No. 3 machine is for general purpose, a firefighter operation lamp is not provided in the quadrangular peripheral part of a car position indicator.

Figure 3:
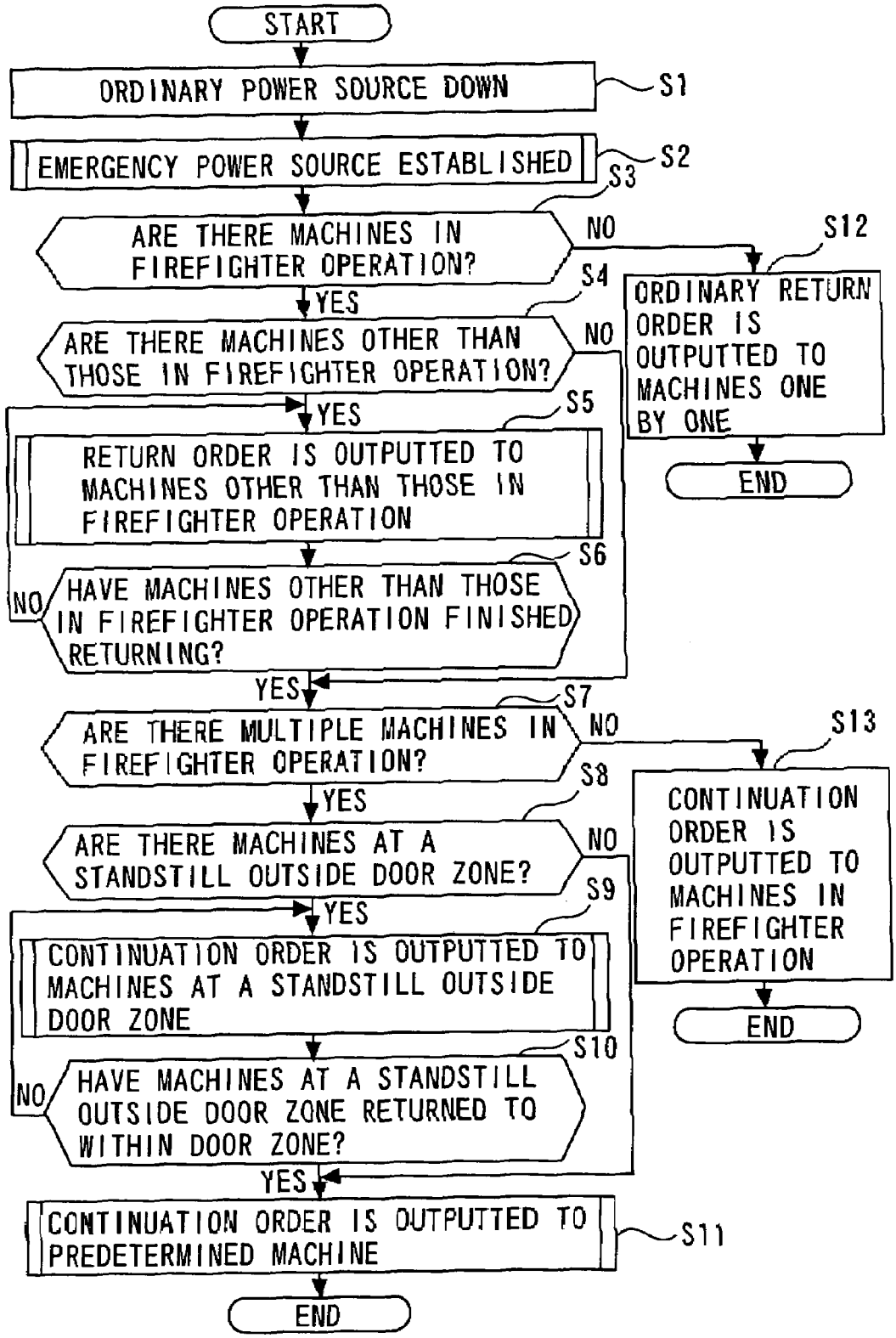
FIG. 3 is a flowchart which shows the operation of group-management controlling means in Embodiment 1 of the present invention.

FIG. 3 is a flowchart which shows the operation of group-management controlling means in Embodiment 1 of the present invention. In this figure, it is assumed that as shown in FIG. 1, a power failure occurs while the No. 1 and No. 2 machines are in firefighter operation and that the No. 1 machine comes to a standstill within a door zone and the No. 2 machine outside the door zone. FIG. 2 shows the No. 1 machine after a power failure occurred, and FIG. 3 shows the operation of the group-management controlling means 2.

In FIG. 3, a power failure occurs at Step Si and an ordinary power source becomes down. At Step S2, an emergency power source is established and the identification contact of emergency power source 1 is closed. At this time, by use of the external information inputting means 3, the group-management controlling means 2 inputs the information that the identification contact of emergency power source 1 has been closed. Next, at Step S3, operation information is sent from the individual-machine controlling means 6*a*, 6*b*, 6*c* of each of the machines and the operating condition of each of the machines is recognized. Unless both the No. 1 machine and the No. 2 machine are in firefighter operation, the group management proceeds to Step S12. If there are machines in firefighter operation at Step S3, the group management proceeds to Step S4. Because the No. 3 machine is a machine other than those in firefighter operation, the group management proceeds to Step S5. If the No. 3 machine is also an emergency elevator and performing firefighter operation, then the group management proceeds to Step S7. Because at Step S5 there is a possibility that there are passengers in machines not in firefighter operation, a return order is preferentially outputted to the No. 3 machine not in firefighter operation and the group management proceeds to Step S6. When at Step S6 the No. 3 machine has finished returning, the group management proceeds to Step S7. When the return has not been finished, the group management returns to Step S5 and the output of a return order to the No. 3 machine is continued. Next, at Step S7 a judgment is made as to whether there are multiple machines in firefighter operation. Because in this case the No. 1 and No. 2 machines are in firefighter operation, the group management proceeds to Step S8. In a case where only one machine is in firefighter operation, the group management proceeds to Step S13. At Step S8 a judgment is made as to whether there are machines in firefighter operation outside the door zone. Information whether there are machines in firefighter operation outside the door zone is outputted from the individual-machine controlling means 6*a*, 6*b*, 6*c* of the elevators to the group-management controlling means 2. Because in this case the No. 2 machine is at a standstill outside the door zone, the group management proceeds to Step S9. If both the No. 1 machine and the No. 2 machine are at a standstill inside the door zone, the group management proceeds to Step S11. Next, at Step S9 a continuation order is outputted to the No. 2 machine, which is a machine at a standstill outside the door zone, and the group management proceeds to Step S10. At Step S10 a judgment is made as to whether machines at a standstill outside the door zone have returned to within the door zone. When in this case the No. 2 machine has returned to within the door zone, the group management proceeds to Step S11. When the No. 2 machine has not yet returned, the group management returns to Step S9 and the output of a continuation order to the No. 2 machine is continued. At Step 11, in a case where machines at a standstill outside the door zone have returned to within the door zone or in a case where a power failure occurs when machines in firefighter operation are within the door zone, a continuation order is outputted to a predetermined machine.

In a case where at Step S12, there is no machine in firefighter operation in the group when a power failure occurs, a return order is outputted to the machines one by one and ordinary return operations are performed.

In a case where at Step S13, there is only one machine in firefighter operation, a continuation order is outputted to the machine in firefighter operation.

Figure 4:
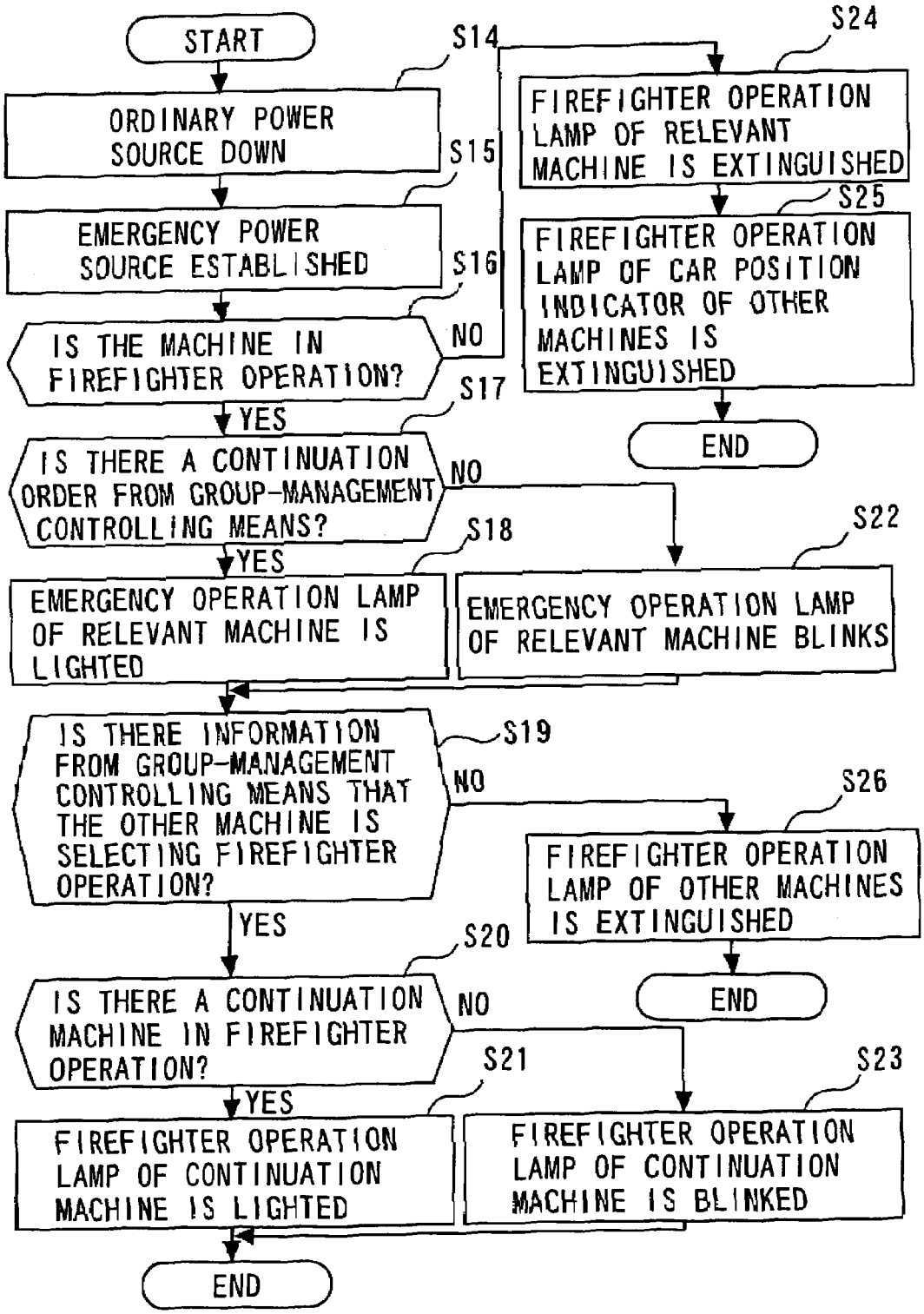
FIG. 4 is a flowchart which shows the operation of individual-machine controlling means in Embodiment 1 of the present invention.

FIG. 4 is a flowchart which shows the operation of individual-machine controlling means in Embodiment 1 of the present invention. In this figure, it is assumed that as shown in the flowchart of FIG. 3, and as shown in FIG. 1, a power failure occurs while the No. 1 and No. 2 machines are in firefighter operation and that the No. 1 machine comes to a standstill within a door zone and the No. 2 machine outside the door zone. FIG. 2 shows the No. 1 machine after a power failure occurred, and FIG. 4 shows the operation of the individual-machine controlling means 6*a* of the No. 1 machine.

In FIG. 4, a power failure occurs at Step S14 and an ordinary power source becomes down. At Step S15, an emergency power source is established and the individual-machine control comes to a wait condition for a return order or a continuation order from the group-management controlling means 2. At step S16 a judgment is made as to whether the machine is in firefighter operation. Because in this case, the No. 1 machine is in firefighter operation, the individual-machine control proceeds to Step S17. If the No. 1 machine is not in firefighter operation, the individual-machine control proceeds to Step S24. Next, at Step S17 a judgment is made as to whether there is a continuation order from the group-management controlling means 2. In this case, the No. 2 machine is at a standstill outside the door zone and the No. 1 machine is at a standstill within the door zone and hence a continuation order is outputted to the No. 2 machine. Therefore, the No. 1 machine becomes unoperational in the firefighter operation mode. Therefore, the individual-machine control proceeds to Step S22 and the emergency operation lamp 10 of the No. 1 machine is blinked. If a continuation order is outputted to the No. 1 machine, the individual-machine control proceeds to Step S18 and the emergency operation lamp 10 of the No. 1 machine is lighted. Next, at Step S19 a judgment is made as to whether there are machines in firefighter operation in the group. On the basis of this judgment, the lighting or extinction of the firefighter lamp of the car position indicator-cum-firefighter operation lamp 11 for the No. 2 machine is decided. Because in this case the No. 2 machine is in firefighter operation, the individual-machine control proceeds to Step S20. If the No. 2 machine is not in firefighter operation, the individual-machine control proceeds to Step S26. At Step S20 a judgment is made as to whether there are continuation machines in firefighter operation in the group. On the basis of this judgment, the lighting or extinction of the firefighter lamp of the car position indicator-cum-firefighter operation lamp 11 for the No. 2 machine is decided. Because in this case the No. 2 machine is at a standstill outside the door zone and a continuation order is outputted from the group-management controlling means 2, the individual-machine control proceeds to Step S21. At Step 21, the firefighter lamp of the car position indicator-cum-firefighter operation lamp 11 for the No. 2 machine is lighted and the emergency operation lamp 10 of the No. 1 machine is blinked. If at Step S20 described above, there is no continuation machine in firefighter operation in the group, the individual-machine control proceeds to Step S23 and the firefighter lamp of the car position indicator-cum-firefighter operation lamp 11 for the No. 2 machine is blinked.

If at Step S16 described above, the machine is not in firefighter operation, the individual-machine control proceeds to Step S24 and the emergency operation lamp 10 of the No. 1 machine is extinguished. The individual-machine control proceeds further to Step S25 and the firefighter lamp of the car position indicator-cum-firefighter operation lamp 11 for the No. 2 machine is extinguished and the car position indicator 12 for the No. 3 machine is also extinguished.

If at Step S19 described above there is no machine in firefighter operation in the group, the individual-machine control proceeds to Step S26 and the firefighter lamp of the car position indicator-cum-firefighter operation lamp 11 for the No. 2 machine is extinguished.

INDUSTRIAL APPLICABILITY

As described above, an emergency power operation apparatus of an elevator related to the present invention can be applied to an elevator which is operated by an emergency power source during a power failure and supports emergency recall operations during emergencies such as a fire and fire fighting activities by firefighter operations.

The invention claimed is:

1. An emergency power operation apparatus of an elevator in which multiple cars are operated one by one during a power failure by use of an emergency power source, characterized in that the emergency power operation apparatus of an elevator comprises group-management controlling means which causes machines not in firefighter operation to preferentially return to an evacuation floor or a rescue floor when a power failure occurs during firefighter operations during a fire and then makes machines in firefighter operation operational.

2. The emergency power operation apparatus of an elevator according to claim 1, characterized in that in a case where there are multiple machines in firefighter operation after all machines not in firefighter operation have finished returning to an evacuation floor or a rescue floor, if there is a machine at a standstill outside a door zone among the machines in firefighter operation, the group-management controlling means causes this machine at a standstill outside the door zone to preferentially become operational.

3. The emergency power operation apparatus of an elevator according to claim 1, characterized in that the group-management controlling means comprises external information inputting means which inputs external information necessary for travel control of elevators in a group, returning machine deciding means which outputs a return order in consideration of the number of elevators capable of being simultaneously operated among the multiple elevators, a predetermined order of priority and the number of machines in firefighter operation in the group, and continuation machine deciding means which outputs a continuation order in consideration of the number of elevators capable of being simultaneously operated, a predetermined order of priority, and the number of machines in firefighter operation in the group.

4. The emergency power operation apparatus of an elevator according to claim 3, characterized in that the external information inputting means is such that inputting is performed from the building side by use of an identification contact of emergency power source which is closed when a switchover to an emergency power source occurs during a power failure.

5. The emergency power operation apparatus of an elevator according to claim 1, characterized in that within a car of each machine there is provided means which displays machines in firefighter operation in the group, machines operational by firefighter operation, and positions of cars of other machines.

6. The emergency power operation apparatus of an elevator according to claim 2, characterized in that within a car of each machine there is provided means which displays machines in firefighter operation in the group, machines operational by firefighter operation, and positions of cars of other machines.

7. The emergency power operation apparatus of an elevator according to claim 3, characterized in that within a car of each machine there is provided means which displays machines in firefighter operation in the group, machines operational by firefighter operation, and positions of cars of other machines.

* * * * *